United States Patent [19]

Minnebraker

[11] Patent Number: 4,572,576

[45] Date of Patent: Feb. 25, 1986

[54] WHEELCHAIR WITH SWINGABLE FOOT SUPPORT ASSEMBLIES

[75] Inventor: Jeffrey P. Minnebraker, Van Nuys, Calif.

[73] Assignee: Quadra Wheelchairs, Inc., Westlake Village, Calif.

[21] Appl. No.: 642,104

[22] Filed: Aug. 20, 1984

[51] Int. Cl.[4] ..... A47C 7/50

[52] U.S. Cl. ..... 297/429; 297/DIG. 4; 297/433

[58] Field of Search ..... 297/429, 433, 436, 223, 297/DIG. 4; 280/42, 647, 649, 650

[56] References Cited

U.S. PATENT DOCUMENTS

| | | | |
|---|---|---|---|
| 2,601,379 | 6/1952 | Everest et al. | 297/433 X |
| 3,189,385 | 6/1965 | Mommsen | 297/433 X |
| 3,453,027 | 7/1969 | Pivacek | 297/433 X |
| 3,574,399 | 4/1971 | Udden | 297/429 |
| 3,854,774 | 12/1974 | Limpach | 297/429 |
| 4,176,879 | 12/1979 | Rodaway | 297/429 |
| 4,415,202 | 11/1983 | Pew | 297/DIG. 10 |

*Primary Examiner*—William E. Lyddane

*Assistant Examiner*—José V. Chen

*Attorney, Agent, or Firm*—Robert J. Schaap

[57] ABSTRACT

A wheelchair having swingable foot supports which are capable of being shifted out of the way of the user to enable easy entry and exit from the wheelchair. The wheelchair generally comprises a pair of laterally spaced apart longitudinally extending side frames. At least one of these side frames and preferably both of the side frames have a main frame section. A foot support is mounted on the front frame section of each side frame and is adapted to be located in a frontal region of the wheelchair for support of the feet of the user. Individual pivot means enable the front frame sections to be angularly shifted out of the plane of the main frame sections and to carry therewith the foot supports. In this way, when the foot support member is shifted laterally, a user having a lower body disability will have easier access to and from the wheelchair. A releasable locking means is provided for normally retaining the first frame section in alignment with the main frame section e.g. generally in a co-planar relationship, when in use. The present invention also provides a foot support assembly of the type which can be used with existing wheelchairs.

15 Claims, 8 Drawing Figures

FIG. 7
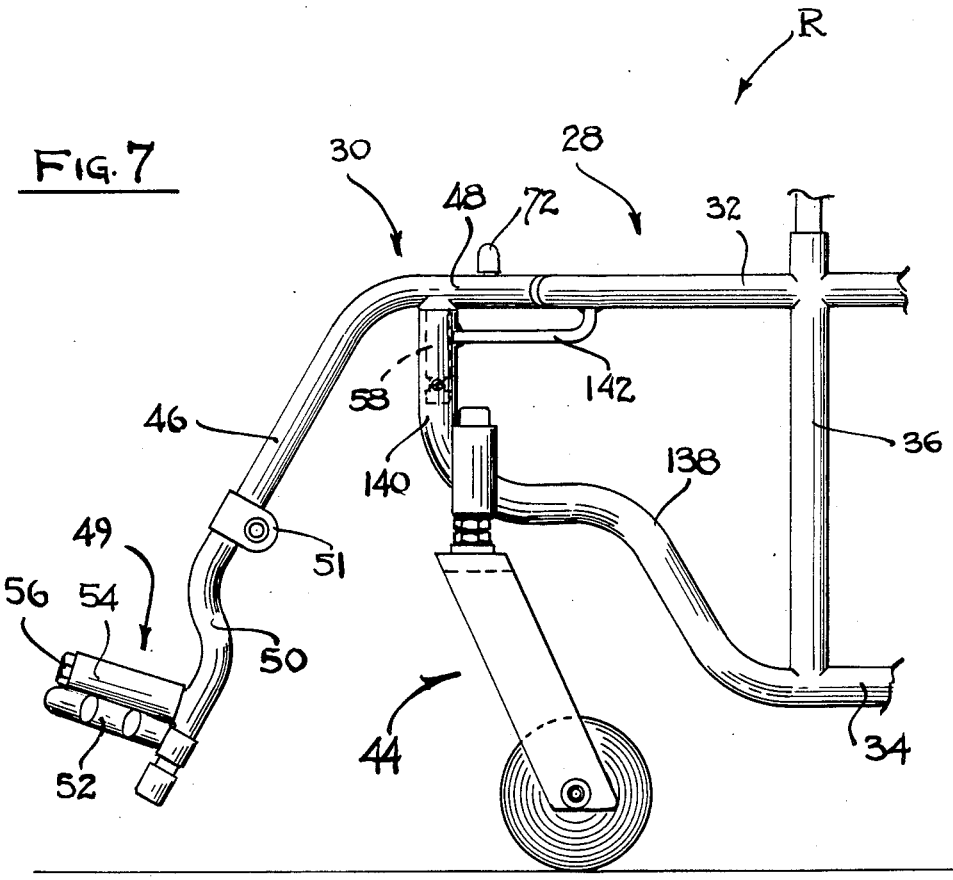
FIG. 5
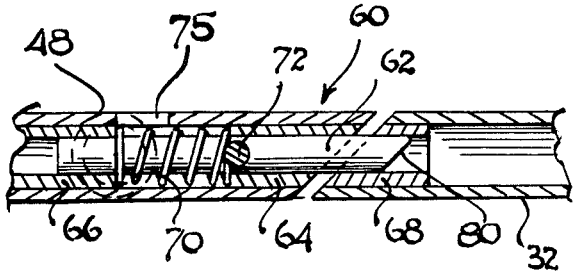
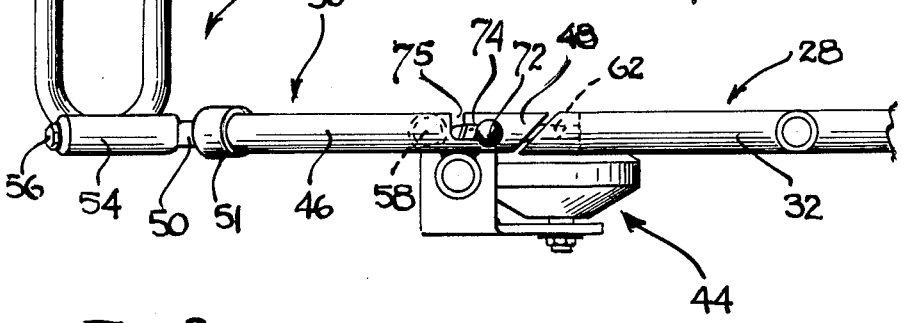
FIG. 3

WHEELCHAIR WITH SWINGABLE FOOT SUPPORT ASSEMBLIES

BACKGROUND OF THE INVENTION

1. Field of the Invention

This invention relates in general to certain new and useful improvements in wheelchairs having moveable foot supports thereon and more particularly, to wheelchairs having moveable foot supports which are capable of being shifted laterally out of the frontal region of the wheelchair to enable easy entry to and exit from the wheelchair and which also enables a wheelchair to be folded into a smaller, more compact unit.

2. Brief Description of the Prior Art

For a long period of time, wheelchair constructions have remained relatively unchanged, except for minor features of construction. These conventional wheelchair constructions were all typically of a box-like construction and were only adapted for normal transport. However, more recently, it has been found to be highly beneficial for paraplegics and others requiring wheelchair use on a relatively permanent basis, to engage in various forms of athletic activities including wheelchair racing, tennis and the like. As a result, there has been an introduction into the market place of various wheelchair constructions which permit racing and other forms of sports activities. Representative of these forms of highly effective racing and sports activity wheelchairs and which also permit normal use and normal transport are those described in U.S. Pat. No. 4,351,540 to Jeffrey P. Minnebraker.

In all cases, conventional wheelchairs typically employ a pair of side frame sections which are connected together at least by means of a seat structure. In some cases, the wheelchairs are capable of being foldable for storage and transport. In all cases, some form of foot support member is generally provided. This foot support member is adapted to support the feet of the user while the latter propels the wheelchair with his or her hands.

The foot support member, for convenient use, must be located in the frontal region of the wheelchair. Moreover, it must be at a height so that the foot of the user is conveniently supported in a position where it is not otherwise uncomfortable to the user. However, the very requirement for a foot support to be in a position for use in transport is inconsistent with the requirements for easy entrance to and exit from the wheelchair.

In addition to the foregoing, and in the case of folding wheelchairs, the side frames of the wheelchairs are usually closed relative to one another for storage and transport permitting the wheelchair to be reduced to a fairly compact unit. However, the foot support assemblies on these wheelchairs generally extend forwardly for a substantial length. Thus, it would be desirable to remove the foot support assemblies or otherwise have them shifted to a position whereby the overall length of the wheelchair can be materially shortened.

Consequently, there has been a need for a wheelchair with a foot support member which is capable of being shifted out of the way in order to permit entry to and exit from the wheelchair but which can be easily shifted back into position for use.

OBJECTS OF THE INVENTION

It is, therefore, one of the primary objects of the present invention to provide a wheelchair having a pair of side frames and with at least one of the side frames having a moveable foot supporting member which is capable of being shifted out of the frontal region of the wheelchair in order to permit exit from and entry to the wheelchair and which is also capable of being shifted back into a frontal region for use in supporting the foot of the user.

It is another object of the present invention to provide a wheelchair of the type stated and which comprises a pair of side frames and at least one of these side frames has a main side frame section and a front frame section and wherein the front frame section is moveable and carries a foot support member to be moved therewith so as to be moveable out of the plane of the main side frame section.

It is a further object of the present invention to provide a wheelchair of the type stated in which a pair of cross lever arms are provided to enable the wheelchair to be folded for storage and transport and opened for use and in which a foot support member can be structured to be located adjacent a side portion of the frame and thereby reduce the overall length thereof when folded.

It is an additional object of the present invention to provide a wheelchair of the type stated in which the moveable foot support member can be releasably locked in a position of use to enable the wheelchair to be used in normal riding activities and in sports and like activities.

It is another salient object of the present invention to provide a wheelchair of the type stated whch can be manufactured at a relatively low cost but which is highly effective in enabling entry to and exit from the wheelchair.

It is still another object of the present invention to provide an assembly which can be used with existing wheelchairs for providing a shiftable foot support member in order to enable entry to and exit from the wheelchair.

With the above and other objects in view, my invention resides in the novel features of form, construction, arrangement and combination of parts presently described and pointed out in the claims.

BRIEF SUMMARY OF THE DISCLOSURE

The present invention, in one aspect, provides a wheelchair having at least one moveable foot support thereon and preferably a pair of moveable foot supports thereon. The wheelchair generally comprises a pair of laterally spaced apart longitudinally extending frame portions located on opposite sides of a wheelchair and are often referred to as "side frames". Further, these side frames are usually connected together to form part of a main frame.

These wheelchair constructions usually include a seat structure which extends between the side frames. The main frame may be rigid or it may be foldable. In the latter case one or more pairs of crossbars connect the side frames together to permit them to be closed relative to one another.

At least one of these side frames is provided with a main frame section and a front frame section. A foot support member is mounted on and carried by the front frame section and is adapted to be located in a frontal region of the wheelchair when in use for support of the foot of the user. In like manner, and in a more preferred aspect, a similar foot support member would be mounted on the opposite side frame, whether or not it was comprised of a front frame section and a main frame section.

A pivot means exists between the front frame section and the main frame section of one or both of the side frames to enable the front frame section to be angularly shifted out of the plane of the main frame section and to carry therewith the foot support. In this way, this construction enables a user to easily and conveniently enter and remove himself or herself from the wheelchair.

A releasable locking means is also provided for retaining the front frame section and the main frame section in a normal position of use. This normal position of use is typically where the front frame section is aligned with the main frame section. The locking means, when released, permits the front frame section to be pivoted with respect to the main frame section and to carry therewith the foot support member. In this way, the foot support is not in an obtrusive position which would interfere with a user of the wheelchair entering or exiting the wheelchair.

In a more preferred aspect of the invention, the front frame section and the main frame section are aligned in longitudinal relationship when in the normal position. The front frame section is pivotal, however, with respect to the main frame section, so that it can be swung away to the side and also carry therewith the foot support member mounted thereon.

In still another embodiment of the invention, it is preferable to employ main frame sections and pivotal front frame sections on each of the opposite side frames. Further, each of the front frame sections will carry a separate foot support member. A separate pivot means is also provided for pivotally securing each of the main frame sections to the associated front frame section and each is also provided with a releasable locking means.

In still another embodiment of the invention, the pivot means comprises a tubular frame column on the main frame section and a post rotatable in the tubular frame column and which post is located on the front frame section. In addition, both the post and the column are vertically disposed with the post being disposed in the upper end of the vertically disposed column.

The releasable locking means which forms part of the wheelchair comprises a shiftable locking plunger in a frame member of one of the frame sections, as for example, a frame bar. This locking plunger is capable of extending into a bore of a frame member in the other of the frame sections. In addition, a handle projects outwardly from the frame member carrying this locking plunger and which is secured to the locking plunger for manually moving the same. A spring means biases the locking plunger into the locked position where it is disposed in the bore.

The wheelchairs of the invention which use the shiftable foot support are generally comprised of a pair of oppositely disposed diametrically enlarged rear wheels located on the opposite sides of the wheelchair. The main frame generally comprises a pair of oppositely disposed horizontally located longitudinally extending frame bars. The front frame sections each also have a horizontally located longitudinally extending frame bar.

The pivot means as aforesaid, pivotally connects the front frame section to the main frame section in such manner that the front frame section can be shifted to a position where the frame bars of each of the sections are co-planar and effectively form an extension of one another in use, or to a position where the front frame section is disposed laterally outwardly of the main frame section. Further, and in some embodiments the front frame section can be swung through an arc substantially greater than 90 degrees so that it is disposed laterally outwardly of the associated main side frame section.

This invention possesses many other advantages and has other purposes which may be made more clearly apparent from a consideration of the forms in which it may be embodied. These forms are shown in the drawings forming and accompanying part of the present specification. They will now be described in detail for purposes of illustrating the general principles of the invention, but it is to be understood that such detailed descriptions are not to be taken in a limiting sense.

BRIEF DESCRIPTION OF THE DRAWINGS

Figures 1, 6:
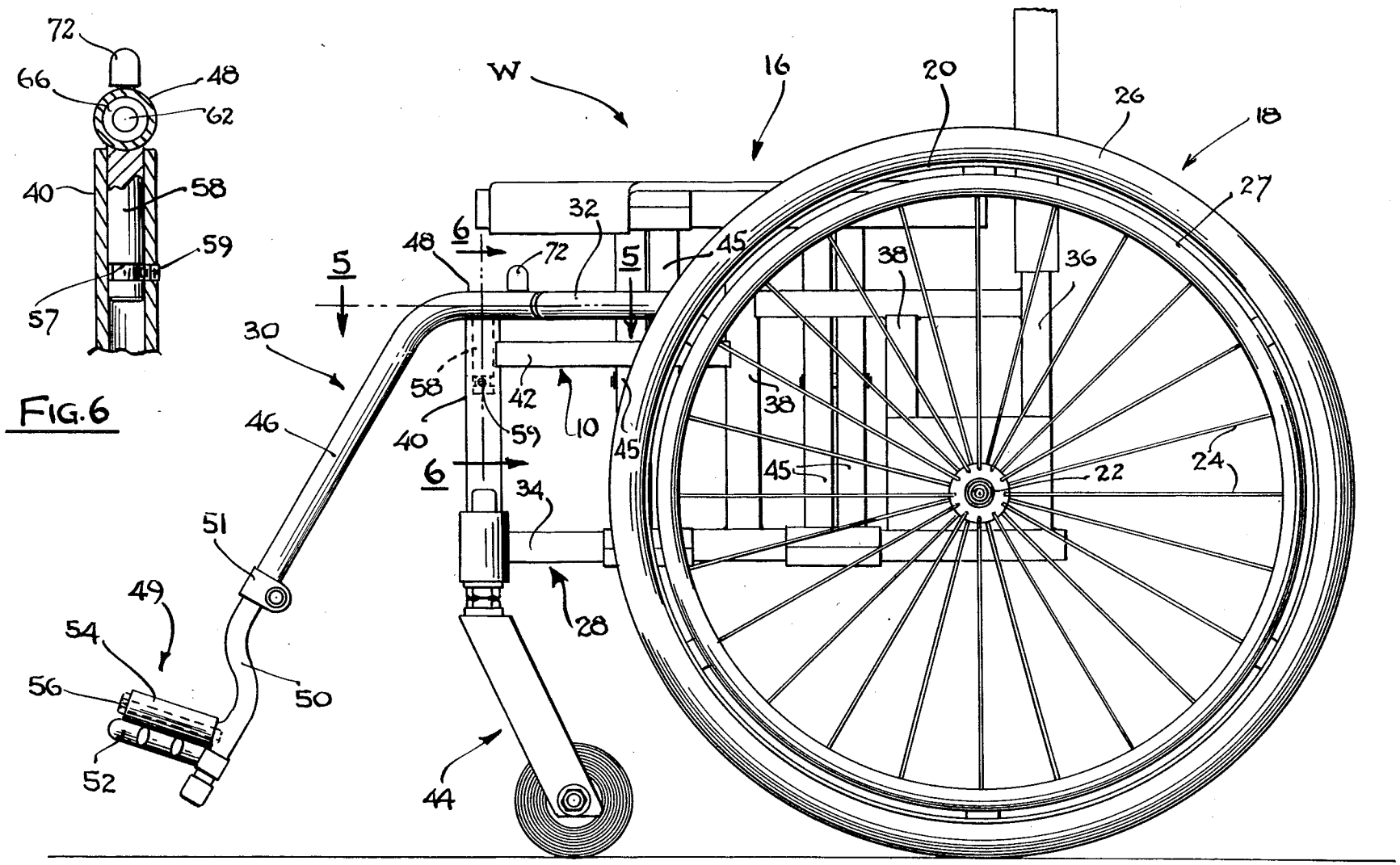
Figure 2:
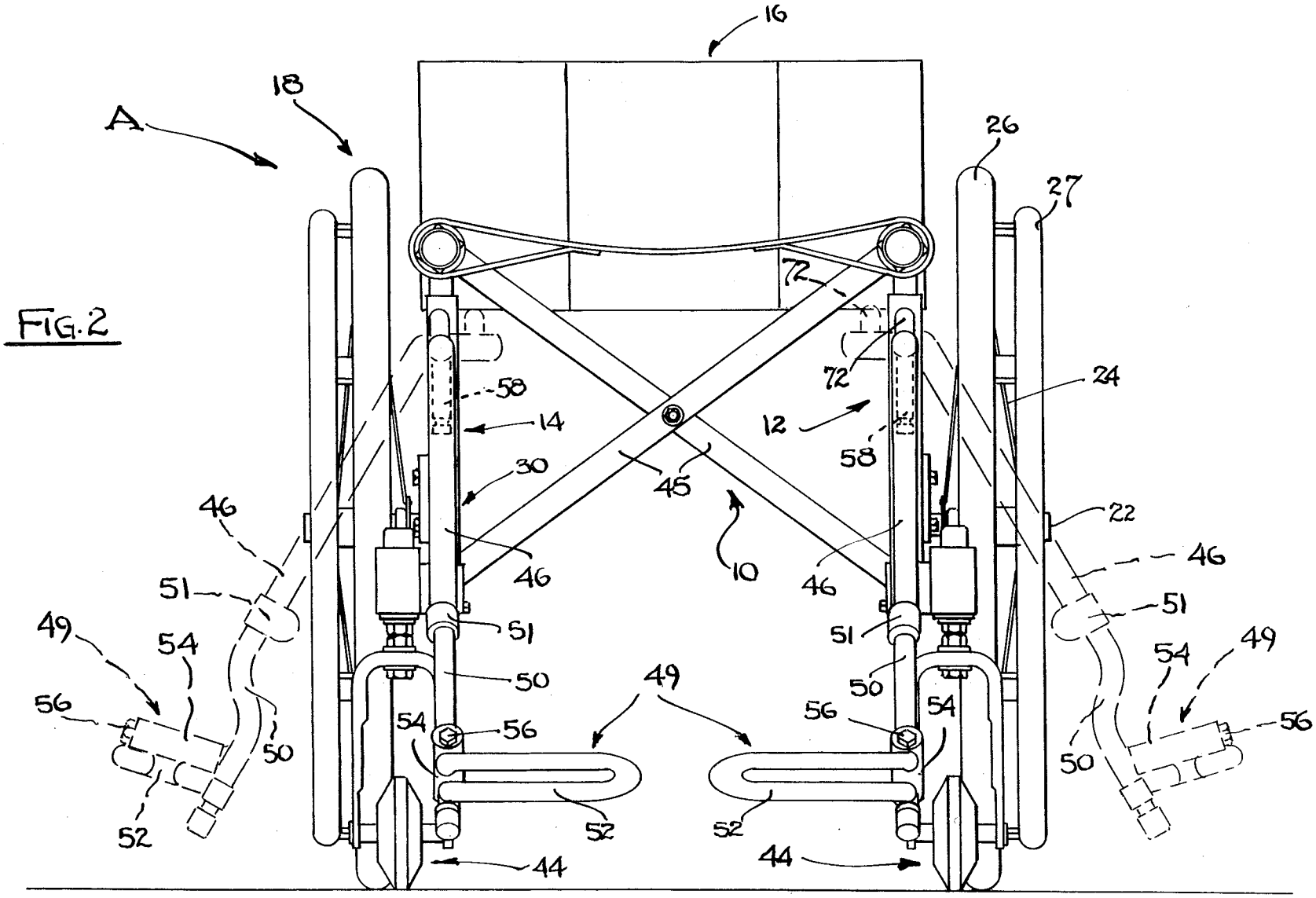
Figure 8:
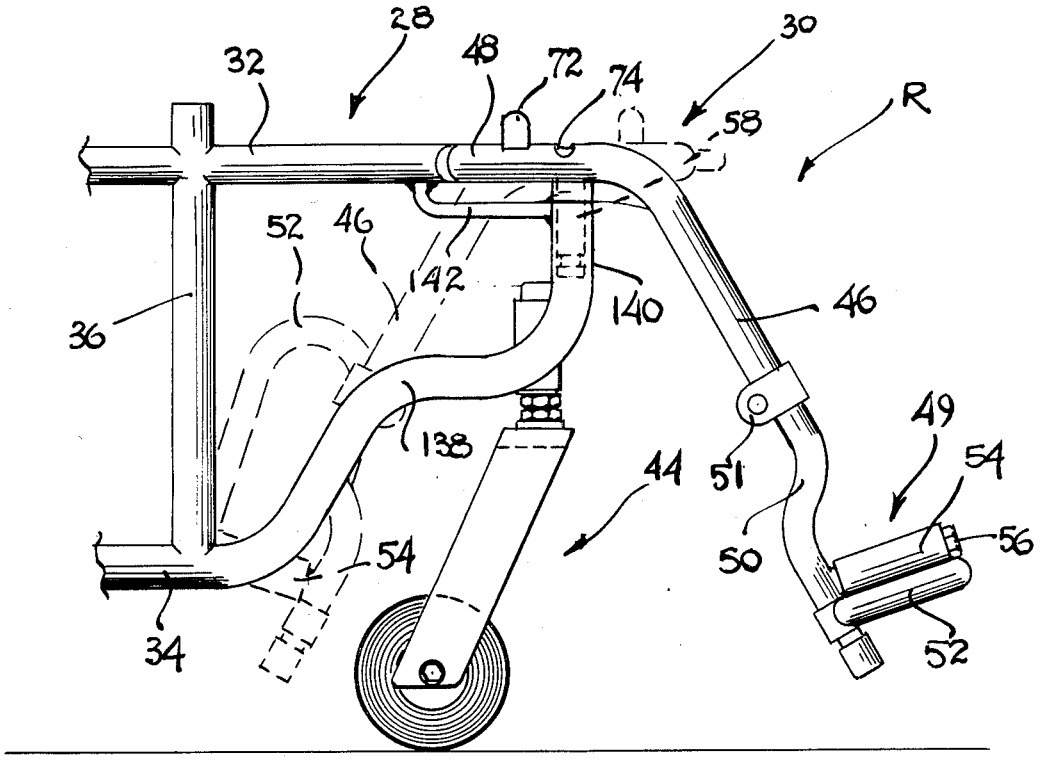
Figure 4:
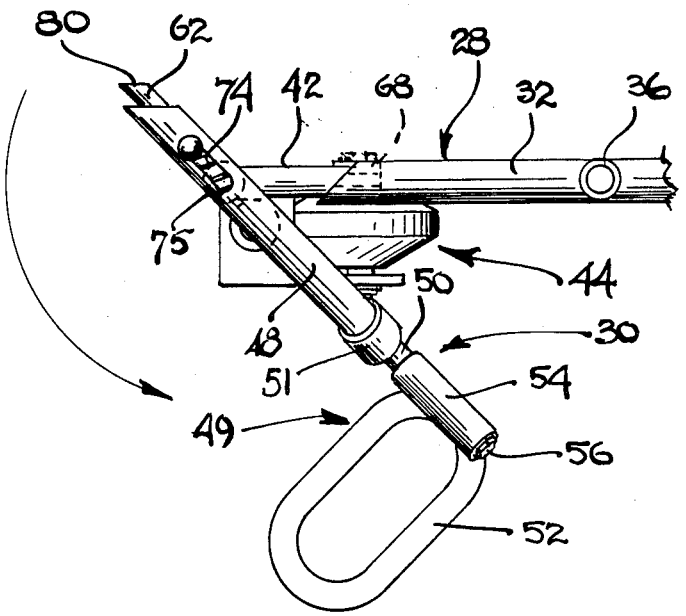

Having thus described the invention in general terms, reference will now be made to the accompanying drawings (four sheets) in which:

FIG. 1 is a side elevational view of a wheelchair utilizing a foot support assembly constructed in accordance with and embodying the present invention;

FIG. 2 is a front elevational view of the wheelchair showing a front frame portion of the wheelchair of the present invention in phantom view;

FIG. 3 is a fragmentary top plan view of a portion of the wheelchair shown in FIGS. 1 and 2 and showing a front frame section aligned with a main frame section;

FIG. 4 is a fragmentary top plan view of that portion of the wheelchair shown in FIG. 3 and showing the front frame section moved to a position to permit exit from and entry to the wheelchair;

FIG. 5 is a horizontal sectional view taken along line 5—5 of FIG. 1;

FIG. 6 is a vertical sectional view taken along line 6—6 of FIG. 1;

FIG. 7 is a fragmentary side elevational view of a modified form of a wheelchair utilizing a foot support assembly constructed in accordance with and embodying the present invention; and FIG. 8 is a side elevational view of the opposite side of the wheelchair frame shown in FIG. 7.

DETAILED DESCRIPTION OF PRACTICAL EMBODIMENTS OF THE INVENTION

Referring now in more detail and by reference characters to the drawings which illustrate practical embodiments of the present invention, W designates a wheelchair having a wheelchair frame 10 which is comprised of a pair of spaced apart side frames 12 and 14.

In the embodiment of the wheelchair as illustrated, a seat structure 16 is conventionally mounted between the side frames 12 and 14. Further, mounted on the rearward portion of the main frame 10 are a pair of rear wheel assemblies 18 and each of which comprises a wheel rim 20 connected to a center mounting hub 22 by means of spokes 24. The wheel assemblies 18 are also each comprised of an inflatable tire 26 mounted on the rim 20 and a hand engageable ring 27 for engagement by the hand of a user to propel the wheelchair. These rear wheel assemblies 18 and the means for mounting them to the wheelchair are conventional in construction and therefore neither illustrated nor described in detail herein.

The side frames 12 and 14 are each identical in construction and one is effectively a mirror image of the other. Therefore, only the side frame 12 is described in detail herein.

By further reference to FIGS. 1, 3 and 4, it can be observed that each side frame is comprised of a main frame section 28 and a front frame section 30. The main frame section 28 is generally comprised of a pair of upper and lower longitudinally extending generally parallel frame bars 32 and 34 and which may be connected at their rearward ends by vertically disposed struts 36 and intermediate their ends by means of one or more vertically disposed struts 38. These longitudinally extending frame bars are also connected at their forwardmost ends by vertically disposed struts 40. The forwardmost strut 40 of main frame section is tubular and functions as vertically disposed column, as hereinafter described in more detail.

Suitably mounted on the forward ends of each of the main frame sections, e.g. the section 12, are front wheel assemblies 44. These front wheel assemblies are generally conventional in construction and are therefore neither illustrated nor described in any further detail herein.

The wheelchair as illustrated is a so-called "foldable wheelchair", that is, it is capable of being closed for storage and/or transport. For this purpose, one or more pairs of cross bars 45, in the manner as illustrated in FIG. 2, can be employed to enable the folding and opening of the wheelchair. Folding wheelchair constructions of this type are taught in my copending U.S. patent application Ser. No. 378,433, filed May 24, 1982.

The front frame sections 30 generally comprise a somewhat downwardly and forwardly extending tubular leg 46 and an integrally formed horizontally disposed tubular leg 48, in the manner as more fully illustrated in FIGS. 1 and 3 of the drawings. These front frame assemblies may be comprised primarily of this tubular member including the legs 46 and 48 in the manner as illustrated, along with a foot support, as hereinafter described in more detail.

Secured to the lower end of the somewhat downwardly and forwardly extending legs 46 are foot supports 49. These foot supports 49 generally comprise a support post 50 which may be telescopically received in the lower open ends of the downwardly extending leg 46 of the front frame section and adjustably retained by means of a clamp 51, as shown in FIGS. 1 and 2. Other means for securing the foot support 49 to the front frame section 30 may also be employed.

Each foot support 49 also comprises a normally laterally extending frame 52 which is secured to and carried by a rotatable sleeve 54 as shown. A bolt 56 journals the sleeve 54 and is secured to the support post 50 as to enable the frame 52 to be shifted through an axis of rotation passing through the bolt 56. In normal use the frames 52 which receive the feet of the user are facing one another and can be rotated through about a 90 degree arc so that they can be vertically disposed as shown in FIG. 8 for storage or transport. Thus, in normal use the foot receiving frames 52 would be facing each other and when the front frame sections are pivoted outwardly toward the outwardly facing sides of the wheelchair, as hereinafter described, the frames 52 may also be folded upwardly through a 90 degree arc when not in use.

The front frame sections 30 are pivotally mounted to the main frame sections 28 by means of a post 58 which is welded or otherwise rigidly secured to the horizontally disposed leg 48. This post 58 is adapted for vertical disposition in the open upper end of the tubular column 40 of the main frame section. In this way, the front frame sections 30 can be swung outwardly, in the manner as illustrated in the solid lines of FIG. 4 and the phantom lines of FIG. 2 through this pivotal connection and they can be returned to a normal position of use, as shown in FIGS. 1 and 3.

In the normal position of use, the front frame section 30 is generally parallel with and in alignment with the remaining portion of the main frame section 28, as more fully illustrated in FIGS. 2 and 3 of the drawings. When shifted outwardly, so as to enable easy exit from and entrance to the wheelchair, the front frame section 30 is angularly disposed and laterally displaced outwardly with respect to the main frame section 28 as shown in FIG. 4.

While the vertically disposed post 58 will normally remain within the column 40, in order to insure against an inadvertent separation, the post 58 could be provided with an annular groove 57 which is engaged by the inner end of a set screw 59, as illustrated in FIG. 6. The set screw would be located so that it fits within the annular groove 57, but does not otherwise frictionally engage the post 58 to preclude rotation thereof.

A releasable locking means 60 is provided for retaining the front frame in an aligned position of use with respect to the main frame section 28. The releasable locking means is more fully illustrated in FIGS. 3, 4 and 5 of the drawings. In this case, the releasable locking means 60 generally comprises a shiftable locking pin 62 which is shiftably received in a sleeve 64 located at the rearward most end of the leg 48 of the front frame section 30, in the manner as illustrated in FIG. 5. At its opposite end, the locking pin 62 is also received within another spaced apart sleeve 66 located within the horizontally disposed leg 48 on the front frame section 30. The locking pin 62 is normally biased rearwardly to extend into a sleeve 68 in the horizontally disposed frame bar 32 of the main frame section 28, in the manner as illustrated in FIGS. 3 and 5. This biasing action results from a compression spring 70 which is disposed between the two sleeves 64 and 66, and bears against the sleeve 66 and a handle 72 in the manner as illustrated. The three sleeves 64, 66 and 68 are all provided with aligned central bores and each are press fitted within the tubular frame members.

The hand engageable handle 72 is press-fitted or otherwise rigidly secured to the locking pin 62 and extends outwardly from the horizontally disposed leg 48 through an enlongate slot 74 formed therein. In addition, if desired, an enlarged hand grip (not shown) can be located on the upwardly extending handle arm 72. The slot 74 is provided with a vertically disposed notch 75 such that the pin 62 can be rotated about its central axis through the action of the handle 72 enabling the latter to be located in the notch 75. In this way, the locking pin 62 can be held in the retracted position.

In accordance with this construction, it can be observed that the front frame section 30 is normally locked to the main frame section 28 in a position of use by means of the locking pin 62 being biased into the bore of the sleeve 68. In order to shift the front frame section and hence the foot support 49 laterally outwardly, the user of the wheelchair merely engages the handle 72 and pushes the same forwardly so as to pull the locking pin 62 out of the bore of the sleeve 68, against the action of the compression spring 70. When the locking pin has been disconnected, e.g. removed from the bore of the sleeve 68, the front frame section 30 can be shifted about the pivotal connection between the post 58 in the column 40.

By further reference to FIGS. 3–5, it can be observed that the ends of the sleeves 68 and the frame member 32 which holds that sleeve as well as the end of the sleeve 64 and the frame member 48 which holds that sleeve are beveled in the manner as shown. In addition, the locking pin 62 has a beveled exposed end 80. Thus, as the front frame section is shifted back to the position of use, that is where it is aligned with the main frame section, the beveled end 80 of the pin will engage the inclined surface 82 of the frame member 32 as well as the sleeve 68 and will be automatically retracted through a caming action from the end 80. When the front frame section 30 becomes in full alignment with the main frame section and particularly the frame member 32 thereof, the locking pin 62 will be automatically biased into the bore of the sleeve 68 by the action of the compression spring 70, thereby retentively locking the front frame section into alignment with the main frame section.

FIGS. 7 and 8 illustrate a modified embodiment of a wheelchair R utilizing a swingable foot support assembly constructed in accordance with and embodying the present invention. In the case of the wheelchair R, like components as employed in the wheelchair W of FIGS. 1 through 6 will be given the same reference numerals.

The main frame section 28 is generally comprised of a pair of upper and lower longitudinally extending generally parallel frame bars 32 and 34 and which may be connected at their ends or intermediate their ends by means of one or more vertically disposed struts 36. Further, the main frame sections each comprise a somewhat serpentine frame bar 138 and which has a vertically disposed upper column portion 140. Further, the upper column portion 140 is connected to the uppermost of the horizontally disposed frame bars 32 by means of a stabilizing bar 142.

The remaining portions of the wheelchair are similar to the wheelchair W and the swingable foot supports operate essentially in the same manner as in the case of the wheelchair W. In this particular embodiment, due to the serpentine shape of the forwardly located portion of the main frame section, the front wheel casters can be easily positioned rearwardly. Moreover, they can also be selectively positioned anywhere along the length of the horizontal portion of the serpentine frame bar 138.

Thus, there has been illustrated and described a unique and novel wheelchair having a moveable foot support thereon and which is capable of being shifted from a position of use to a position where it is angulated outwardly with respect to the main frame of the wheelchair to thereby enable easy exit from and entry to the wheelchair. The invention also provides a unique and novel foot support assembly for use with wheelchairs. Thus, the present invention fulfills all of the objects and advantages which have been sought. It should be understood that many changes, modifications, variations, and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention which is limited only by the following claims.

Having thus described our invention, what we desire to claim and secure by Letters Patent is:

1. A wheelchair having moveable foot supports thereon moveable from a position which supports a users foot in normal use to a position swung outwardly therefrom, said wheelchair comprising:

(a) a pair of laterally spaced apart longitudinally extending side frames, (b) at least one of said side frames having a main frame section with a generally horizontally disposed tubular frame member having an interior central bore, said side frame also having a front frame section generally longitudinally aligned with the main frame section when in normal use, said front frame section having a tubular frame member with an interior bore which is aligned with the tubular frame member and interior bore on the main frame section in normal use, (c) a foot support mounted on and carried by said front frame section and adapted to be located in a frontal region of said wheelchair when in use for support of the foot of a user, (d) pivot means pivotally mounting the front frame section to the main frame section and enabling said front frame section to be angularly shifted out of the plane of the main frame section where it is normaly generally aligned therewith, and to carry therewith said foot support to thereby enable a user easy and convenient entry and exit, and (e) releasable locking means for normally retaining said front frame section and main frame section in a generally aligned position of normal use, said releasable locking means comprising:

(1) a shiftable locking plunger disposed within the bore of one of said front frame tubular frame member or main frame tubular frame member and adapted to extend into the bore of the other to hold the front frame member in locking position in a normal use, (2) an opening in one of said frame members having the locking plunger therein, (3) an engagable member connected to said locking plunger and extending outwardly through said opening to be engagable by a user to shift the locking plunger out of the frame member which it holds in locked position of normal use to thereby release the front frame section thereby allowing the latter to pivot about said pivot means.

2. The wheelchair of claim 1 further characterized in that said pivot means comprises a tubular frame column on a main frame section and a post rotatable in said tubular frame column and which post is located on the front frame section.

3. The wheelchair of claim 2 further characterized in that said post on said front frame section is retained in said tubular column on the main frame section to avoid separation therefrom.

4. The wheelchair of claim 2 further characterized in that said column and post are vertically disposed.

5. The wheelchair of claim 4 further characterized in that each of said frame comprise a main frame section and a front frame section and each carries a foot support member, a separate pivot means pivotally secures each of said front frame sections to the associated main frame section and each is provided with a substantially identical releasable locking means.

6. The wheelchair of claim 1 further characterized in that spring means biases said locking plunger into the locked position where it is received in said bore.

7. A wheelchair comprising:

(a) a main frame having a pair of oppositely disposed horizontally located longitudinally extending tubular main frame bars with each having an interior bore, (b) a pair of oppositely disposed diametrically enlarged rear wheels located on opposite sides of said wheelchair, (c) a pair of oppositely disposed front frame sections and each front frame section having a horizontally located longitudinally extending tubular front frame bar section with each having an interior bore in alignment with the interior bore of a respective one of the bores of the horizontally located main frame bar, (d) a separate pivot means for pivotally connecting each of said front frame sections to the main frame in such manner that the front frame sections can be shifted (1) from a first position where the front bar sections are co-planar to and effectively form extensions of the associated main frame bar (2) to a second position where the front frame sections are disposed laterally outwardly of the longitudinally extending main frame bars, (e) a separate foot rest carried by each of said front frame sections and capable of being moved therewith between the first and second positions so that the foot rests can support the foot of the user in the first position and can be swung out of the way to the second position, and (f) a separate releasable locking means associated with each front frame secton for normally retaining said front frame section in a generally aligned position of normal use with the horizontally located longitudinally extending tubular main frame bars of said main frame, each said releasable locking means comprising:

(1) a shiftable locking plunger disposed within the bore of one of said front frame section tubular frame bar section or main tubular frame bar and adapted to extend into the bore of the other to hold the front frame section in a locked position in normal use, (2) an opening in one of said frame bars having the locking plunger therein, (3) an engagable member connected to said locking plunger and extending outwardly through said opening to be engagable by a user to shift the locking plunger out of the frame bar or frame bar section it holds in locked position of normal use, to thereby release the front frame sections thereby allowing the latter to pivot about said pivot means.

8. The wheelchair of claim 7 further characterized in that each said main frame bar is located adjacent at least one somewhat vertically disposed frame bar which is at least more vertically than horizontally disposed, and each said pivot means comprises a somewhat vertically disposed frame section bar on said front frame section which is at least more vertically than horizontally disposed, and said somewht vertically disposed frame bars on said main frame and front frame sections are pivotally connected to one another.

9. The wheelchair of claim 7 further characterized in that the releasable locking means operatively associated with each front frame section and the associated longitudinally extending frame bar of the main frame are manually actuable by the user of the wheelchair.

10. The wheelchair of claim 7 further characterized in that said shiftable plunger of each locking means is biased to a locked position and which may be retracted to an unlocked position.

11. The wheelchair of claim 9 further characterized in that a spring means biases said plunger of each locking mechanism to a locked position when the front frame sections are in a normal position of use, and a manually engagable member is on each said plunger to retract some against the action of the spring means.

12. A foot support assembly for use with wheelchairs of the type having a main frame, and a pair of enlarged rear wheels and a pair of diametrically smaller front wheels, said foot support assembly comprising:

(a) a tubular front frame member having a horizontally located front frame bar with an interior bore pivoted with respect to a horizontally located main frame bar on the main frame and which main frame bar has an interior bore capable of being aligned with the bore of said front frame bar, (b) a foot support mounted on and carried by said front frame member and adapted to be located in a frontal region of said wheelchair when in use for support of the foot of a user, (c) a pivot means pivotally mounting the front frame member to the main frame enabling said front frame member to be angularly shifted out of the plane of the main frame and to carry therewith said foot support to thereby enable a user easy and convenient entry and exit, and (d) releasable locking means for normally retaining said front frame member and main frame in a generally aligned position of use, said releasable locking means comprising:

(1) a shiftable locking plunger disposed within the bore of one of said front tubular frame member or main frame bar and adapted to extend into the bore of the other to hold the front frame member in a locked position in normal use, (2) an opening in one of said frame bars having the locking plunger therein, (3) an engagable member connected to said locking plunger and extending outwardly through said opening to be engagable by a user to shift the locking plunger out of the frame bar to thereby release the front frame member thereby allowing the latter to pivot about said pivot means.

13. The wheelchair of claim 12 further characterized in that the front frame member and longitudinally extending main frame bar on the main frame are co-planar in longitudinal relationship in a generally normal position of use.

14. The wheelchair of claim 12 further characterized in that said pivot means comprises a tubular frame column on said main frame and a post rotatable in said tubular frame column and which post is located on the said front frame member.

15. The wheelchair of claim 14 further characterized in that said column and post are vertically disposed.

* * * * *